US009943751B2

(12) United States Patent
Riordan et al.

(10) Patent No.: US 9,943,751 B2
(45) Date of Patent: Apr. 17, 2018

(54) AUTOMATIC PLAYING CARD SHUFFLER AND OTHER CARD-HANDLING DEVICES CONFIGURED TO DETECT MARKED CARDS AND METHOD OF USING THE SAME

(71) Applicant: Shark Trap Gaming & Security Systems, LLC, Las Vegas, NV (US)

(72) Inventors: Michael Earnest Riordan, Las Vegas, NV (US); Louis Wilson DeGregorio, Las Vegas, NV (US); Dino Louis DeGregorio, Las Vegas, NV (US); Steven Louis Forte, Las Vegas, NV (US)

(73) Assignee: Shark Trap Gaming & Security Systems, LLC, Las Vegas, NV (US)

( * ) Notice: Subject to any disclaimer, the term of this patent is extended or adjusted under 35 U.S.C. 154(b) by 0 days.

(21) Appl. No.: 15/336,779

(22) Filed: Oct. 27, 2016

(65) Prior Publication Data

US 2017/0043242 A1 Feb. 16, 2017

Related U.S. Application Data

(63) Continuation-in-part of application No. 15/001,039, filed on Jan. 19, 2016, now Pat. No. 9,776,072, which (Continued)

(51) Int. Cl.

| | |
|---|---|
| ***A63F 1/12*** | (2006.01) |
| *A63F 9/06* | (2006.01) |
| *A63F 9/24* | (2006.01) |

(52) U.S. Cl.

CPC ..... *A63F 1/12* (2013.01); *A63F 2009/0609* (2013.01); *A63F 2009/2419* (2013.01); *A63F 2250/287* (2013.01); *A63F 2250/58* (2013.01)

(58) Field of Classification Search

CPC ..... A63F 1/12; A63F 1/14; A63F 1/18; A63F 2009/2149

See application file for complete search history.

(56) References Cited

U.S. PATENT DOCUMENTS 5,707,287 A * 1/1998 McCrea, Jr. ..... A63F 1/12 273/292
6,726,205 B1 * 4/2004 Purton ..... A63F 1/14 273/148 R (Continued)

OTHER PUBLICATIONS

International Preliminary Report on Patentability, dated Nov. 21, 2014 (14 pages).

(Continued)

*Primary Examiner* — Jay Liddle
*Assistant Examiner* — Alex F. R. P. Rada, II
(74) *Attorney, Agent, or Firm* — Fisher Broyles, LLP; Rob L. Phillips

(57) ABSTRACT

An automatic playing card shuffler incorporating means for detecting marked cards. One or more light spectrum emitters or variable light spectrum illuminators transmit light at frequencies/wavelengths which is reflected off card backs through one or more spectrum filters causing invisible markings to become visible. A camera may capture images of the now visible markings. A camera and software collaborate to capture images and analyze the same for markings on the card backs such as smudges, nicks and scuffs and edge demarcations. The automatic playing card shufflers are configured to not only detect marked cards but to detect patterns relative to the card markings. The automatic card shufflers are communicatively linked with a casino management system and/or security system such that casino personnel may be alerted in real time to the discovery of marked cards.

27 Claims, 12 Drawing Sheets

Related U.S. Application Data is a continuation of application No. PCT/US2014/047227, filed on Jul. 18, 2014.

(60) Provisional application No. 61/847,710, filed on Jul. 18, 2013.

(56) References Cited

U.S. PATENT DOCUMENTS 6,886,829 B2 5/2005 Hessing et al.
7,735,657 B2 6/2010 Johnson
7,764,836 B2 7/2010 Downs, III et al.
7,933,448 B2 4/2011 Downs, III
7,976,023 B1 7/2011 Hessing et al.
8,012,029 B2 9/2011 Johnson
8,070,574 B2 12/2011 Grauzer et al.
8,150,157 B2 4/2012 Downs, III et al.
8,777,710 B2 7/2014 Grauzer et al.
8,986,091 B2 3/2015 Grauzer et al.
9,259,640 B2 2/2016 Grauzer et al.
9,316,597 B2 * 4/2016 Blazevic ..... A63F 1/12
9,339,723 B2 5/2016 Grauzer et al.
2004/0026636 A1 * 2/2004 Shigeta ..... A63F 1/02 250/556
2006/0279040 A1 12/2006 Downs, III et al.
2008/0113783 A1 * 5/2008 Czyzewski ..... A63F 3/00157 463/29
2009/0066021 A1 * 3/2009 Shigeta ..... A63F 1/14 273/149 R
2009/0286597 A1 * 11/2009 Shigeta ..... A63F 1/14 463/29
2009/0291758 A1 11/2009 Moretti et al.
2010/0314834 A1 * 12/2010 Shigeta ..... A63F 1/10 273/293
2010/0327525 A1 * 12/2010 Shigeta ..... A63F 1/02 273/149 R
2011/0285082 A1 11/2011 Krenn et al.
2012/0306152 A1 12/2012 Krishnamurty et al.
2013/0307215 A1 * 11/2013 Shigeta ..... A63F 1/14 273/149 R
2014/0346733 A1 * 11/2014 Shigeta ..... A63F 1/02 273/292
2014/0347471 A1 * 11/2014 Blazevic ..... G01N 21/8806 348/128
2015/0373284 A1 * 12/2015 Blazevic ..... G01N 21/95 348/143

OTHER PUBLICATIONS

International Preliminary Report on Patentability, dated Oct. 7, 2014 (13 pages).
International Preliminary Report on Patentability, dated Jan. 22, 2015 (14 pages).

* cited by examiner

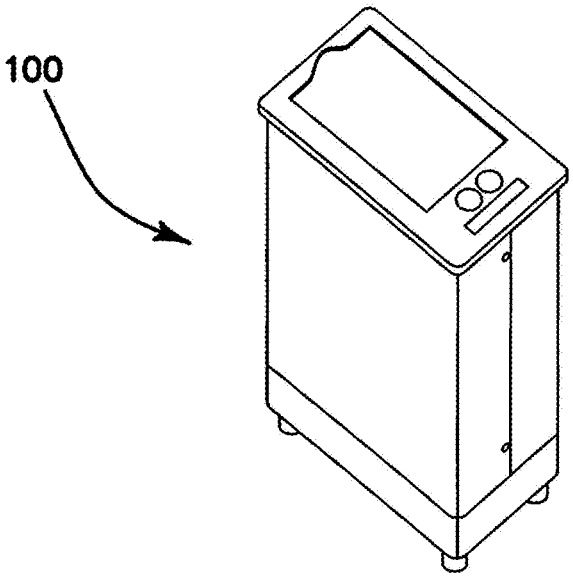
FIG. 1A
FIG. 1B
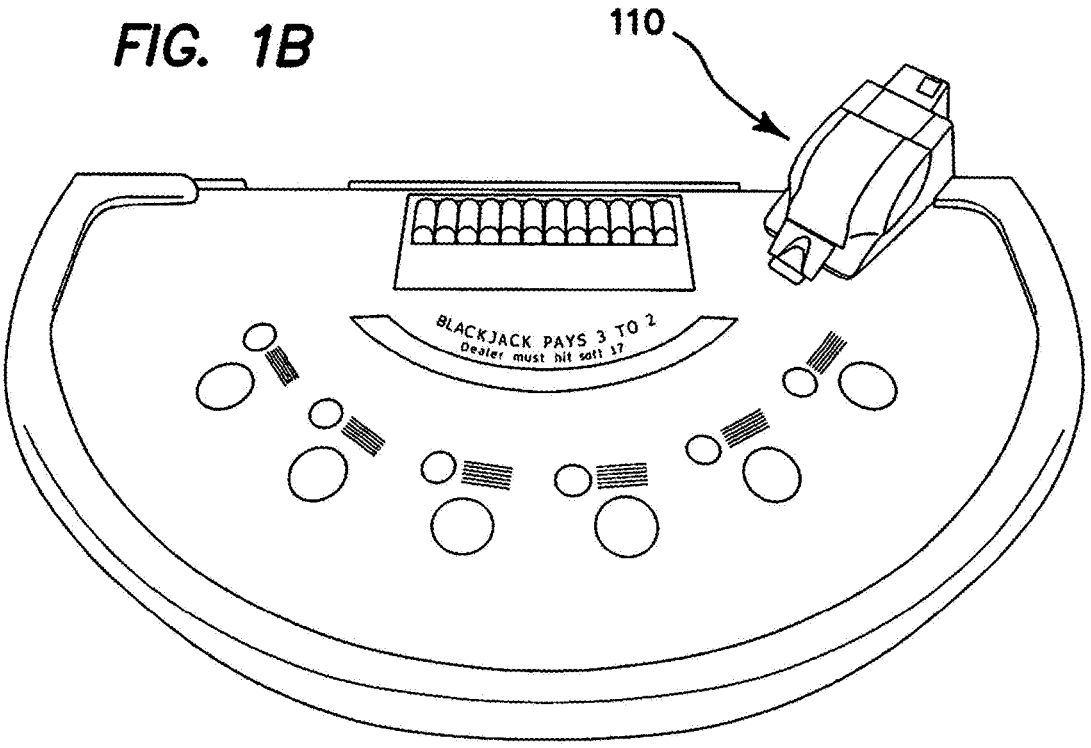

AUTOMATIC PLAYING CARD SHUFFLER AND OTHER CARD-HANDLING DEVICES CONFIGURED TO DETECT MARKED CARDS AND METHOD OF USING THE SAME

CROSS-REFERENCES

This application is a continuation-in-part of U.S. patent application Ser. No. 15/001,039 filed Jan. 19, 2016 which is a continuation of PCT Application No. PCT/US2014/047227 filed Jul. 18, 2014 and U.S. Patent Application No. 61/847,710 filed Jul. 18, 2013 from which PCT Application No. PCT/US2014/047227 claims priority, all of which are incorporated herein by reference for any and all purposes.

FIELD OF THE INVENTION

The embodiments of the present invention relate to an automatic playing card shuffler and other card-handling devices incorporating means for detecting various types of marked cards to maintain the integrity of casino games.

BACKGROUND

Cheats have been around as long as gambling. With the advancement of technology, come new methods for cheats to take advantage. One such method involves marking playing cards such that cheats are able to discern a card's identity (i.e., rank and suit) from the card back. Knowing the rank and suit provides the cheat with a tremendous advantage over the casino (e.g., blackjack) or competing players (e.g., poker). Marking playing cards can take many forms including the use of invisible chemicals viewable through special lenses, the use of chemicals only viewable via electronic means, physical demarcations and anomalies, smudges, etc.

It would be useful and advantageous to develop an automatic playing card shuffler and other card-handling devices incorporating means for detecting marked cards of various types to prevent cheats from taking advantage of casinos and competing players.

SUMMARY

Accordingly, one embodiment of the present invention comprises: an automatic playing card shuffler incorporating means for detecting marked cards. Automatic playing card shufflers have been around for approximately 25 years and are now ubiquitous in the casino industry. Automatic playing card shufflers speed up games, generate reliable, random card shuffles and combat card counters. Automatic playing card shufflers transport cards using various technologies which ultimately randomize the order of the cards.

In one embodiment of the present invention, one or more light spectrum emitters or variable light spectrum illuminators transmit light at frequencies/wavelengths which is reflected off card backs through one or more spectrum filters causing invisible markings to become visible. A camera (or other image capturing device) captures images of the now visible markings.

In one embodiment, a camera and software collaborate to capture images and analyze the same for markings on the card backs such as smudges, nicks, scuffs and edge demarcations. Software may also be configured to analyze cards through and cause an image to be captured responsive to the detection of a marked card.

In one embodiment, the automatic playing card shufflers are configured to not only detect marked cards but to detect patterns relative to the card markings. For example, the automatic playing card shufflers may recognize that markings on multiple Aces in the deck of cards are indicative of an intentional act rather than an inadvertent act.

In one embodiment, the automatic card shufflers are communicatively linked with a casino management system and/or security system such that casino personnel may be alerted in real time to the discovery of marked cards.

The discovery of one or marked cards may prompt one or more responses including: (i) recordation of an image of the marked card(s); (ii) transmission of an alert to casino personnel; (iii) trigger of software configured to determine card marking patterns; and/or (iv) continued analysis to seek the identity of the person or persons responsible for the card markings.

In another embodiment, a card sorting, verification and/or cancellation device incorporates means for detecting marked cards. Card cancellation devices are used to verify the ranks, suits and numbers of playing cards from retired decks of cards. The devices may also permanently deface the playing cards to allow the playing cards to be sold to patrons. For example, the card cancellation device may punch a hole in the playing cards. A card sorting and verification device ensures full decks and sorts the cards by suits and ranks.

Other variations, embodiments and features of the present invention will become evident from the following detailed description, drawings and claims.

BRIEF DESCRIPTION OF THE DRAWINGS

FIGS. 1A and 1B illustrate in-table and on-table automatic playing card shufflers, respectively, according to the prior art;

DETAILED DESCRIPTION

Figure 2:
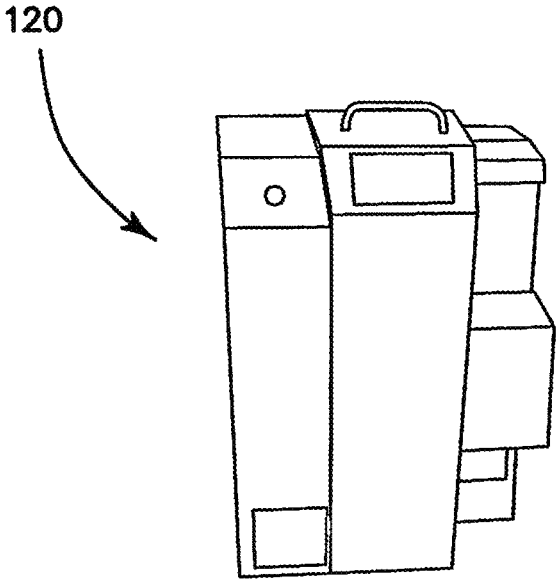
FIG. 2 illustrates a conventional deck verification device according to the prior art.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to those skilled in the relevant art and having possession of this disclosure, are to be considered within the scope of the invention claimed.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagram block or blocks. As used herein, a "terminal" should be understood to be any one of a general purpose computer, as for example a personal computer or a laptop computer, a client computer configured for interaction with a server, a special purpose computer such as a server, or a smart phone, soft phone, tablet computer, personal digital assistant or any other machine adapted for executing programmable instructions in accordance with the description thereof set forth above.

FIGS. 1A and 1B show conventional automatic playing card shufflers 100 (in-table), 110 (on-table) and FIG. 2 shows a conventional deck verification device 120. These are the types of automatic card playing shufflers and devices with which the embodiments of the present invention may be used but those skilled in the art will recognize that any automatic playing card shufflers (e.g., single deck, multi-deck, batch, random-position, random-selection, etc.), card verification devices and card cancellation devices are suitable for the embodiments of the present invention. Card shuffling devices may use rollers, elevators, bins, ejectors, carousels, etc., to move and randomly organize the unshuffled group of cards into a random shuffled group of cards. U.S. Pat. No. 9,573,047 owned by applicant and incorporated herein by reference discloses a shuffler of the type which may utilize the embodiments of the present invention.

Figure 3:
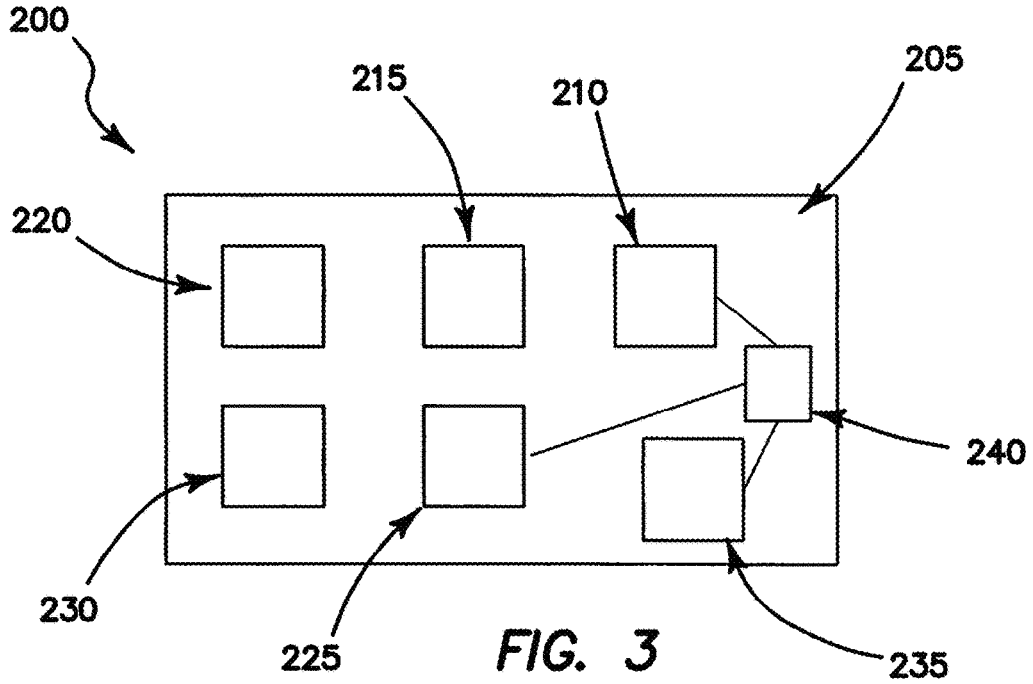
FIG. 3 illustrates a block diagram of an automatic playing card shuffler incorporating means for detecting marked cards according to the embodiments of the present invention.

FIG. 3 shows a block diagram 200 of an automatic playing card shuffler 205 incorporating means for detecting marked cards. In this instance, the means for detecting marked cards comprises one or more cameras 210 (or other image capturing devices), one or more light spectrum emitters or variable light spectrum illuminators/emitter 215, one or more spectral filters 220, one or more edge sensors 225, one or more receivers 230 and/or one or more data transmitters 235. There can also be temporary memory 240 for storing certain data including identification of marked cards. In one embodiment, the automatic playing card shuffler 205 includes a display device for alerting the dealer or other casino personnel that one or more marked cards have been detected. Ideally, the display device is not visible to the players so as not to alert any players that may be responsible for the card markings. As set forth below, a wireless system may also alert a casino management system and/or security system to the discovery of marked playing cards. The position of the various components described herein is dependent upon the type of automatic playing card shuffler, deck verification device and/or card cancellation device.

The one or more cameras 210 are positioned to capture the front and back of the playing cards as the playing cards are moved individually within the automatic playing card shuffler 205. In one embodiment, one camera 210 is positioned proximate to a spectral filter 220 and is configured to capture an image of the card backs as the one or more light spectrum emitters 215 is in operation. In this manner, the camera 210 captures any invisible markings made visible by the spectral filter 220 and light spectrum emitter 215. In one embodiment, the one or more spectrum emitters/variable light spectrum illuminators 215 may comprise an infrared emitter, UV emitter and/or incandescent emitter. Other emitters/variable light spectrum illuminators or devices capable of transmitting desirable light wavelengths may be utilized as well. To enhance the capability to detect invisible (to the naked eye) marks, the spectral filter 220 is configured to prevent the passage of certain light wavelengths while allowing others to pass through to the camera 210. The spectral filter 220 may take many forms and are selected to cooperate with the various spectrum emitters/variable light spectrum emitter/illuminator 215. The spectral filter 220 enhances the ability to detect polarized and subtle reflectivity facilitated by the spectrum emitters/variable light spectrum illuminator 220.

Figure 7:
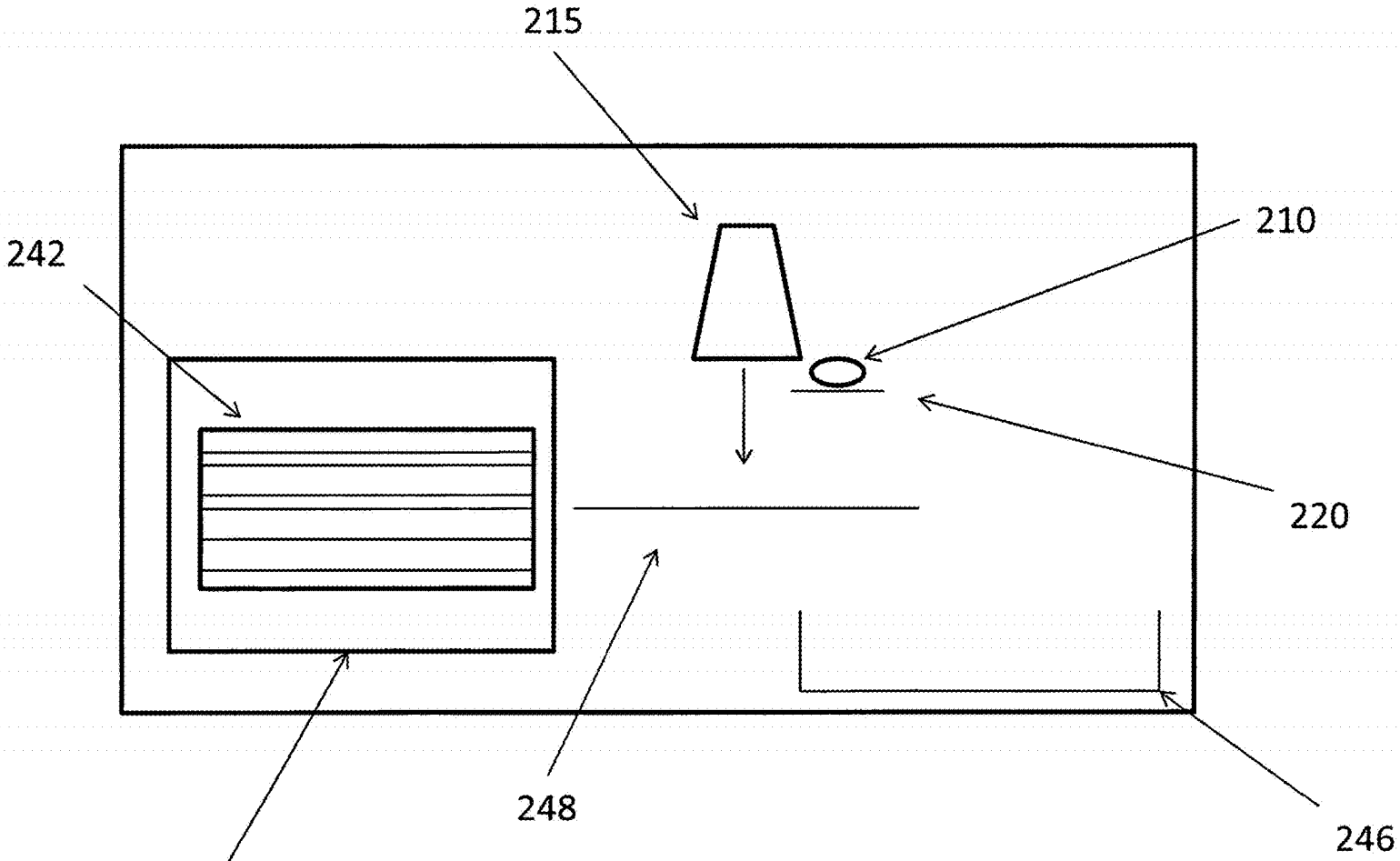
FIG. 7 illustrates a block diagram of an exemplary automatic shuffler incorporating a card mark detection system according to the embodiments of the present invention.

FIG. 7 shows an exemplary arrangement of an image capturing device 210, illuminator 215 and spectral filter 220 relative to a group of cards 242, mechanism to move and randomly organize said cards 244 and shuffled card bin 246. Moving card 248 is shown being acted on by the image capturing device 210, illuminator 215 and spectral filter 220.

Figure 4:
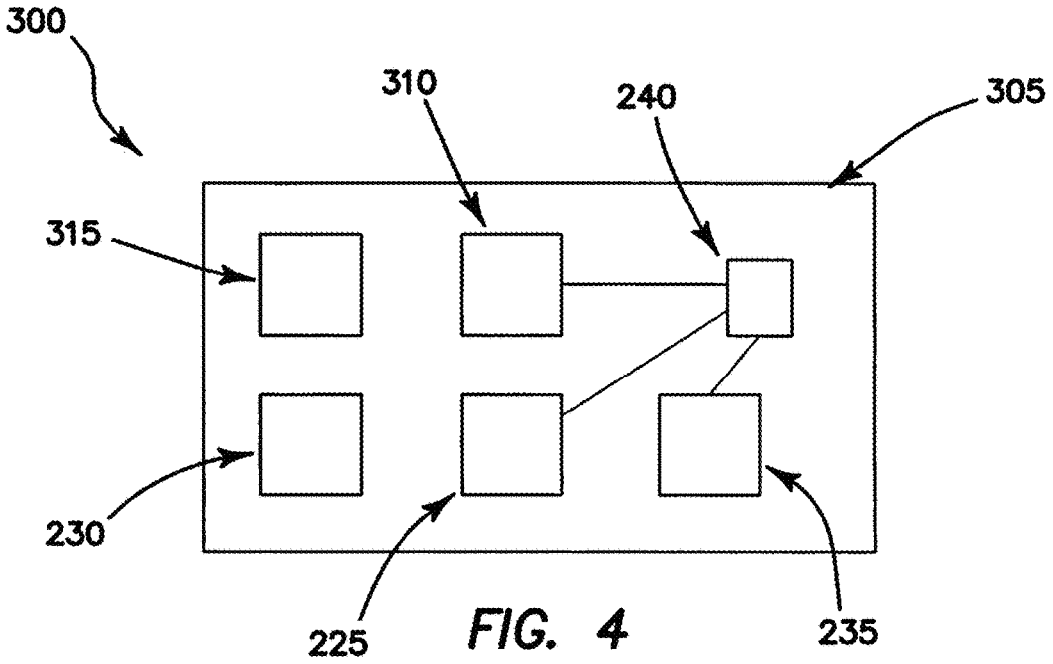
FIG. 4 illustrates another block diagram of an automatic playing card shuffler incorporating means for detecting marked cards according to the embodiments of the present invention.

In another embodiment (shown in FIG. 4) suitable for automatic playing card shufflers or other card-handling devices with limited internal space, a different imaging method may be used. FIG. 4 shows block diagram 300 of automatic playing card shuffler 305. In this embodiment, a contact image sensor 310 and a light emitter 315 capable of emitting near infrared (IR) to ultraviolet (UV) wavelengths (i.e., 350 nanometer wavelengths to 1100 nanometer wavelengths) in 75 nanometer steps such that markings are evident based on their absorption and/or excess reflectivity at given wavelengths. In one embodiment, the playing card is passed beneath or above the contact image sensors 310 which consists of a series of silicon or germanium detectors which respond to the wavelengths of light described above. In one embodiment, the detectors used in the contact image sensors 310 are set for 200 pixels per inch although the detectors can be more or less focused depending on the application needs. In practice, the cards are transported very close to the contact image sensors 310 such that the detectors are nearly in contact with the playing cards. The playing cards are then illuminated by high speed pulses via the light emitter 315, in sequence, with the wavelengths from 350 nanometers to 1100 nanometers in 10 separate illuminations. This process takes approximately 1/1000 of a second. The playing card then advances to a next scan position where the process is repeated.

In one embodiment, playing cards are transported at a rate providing a resolution of 200 by 200 pixels per square inch giving 350,000 scan points for every playing card which occurs at each of 10 scan locations resulting in a total of 3.5 million points of analysis. Those skilled in the art will recognize that the rate, resolution and number of scanning locations can be altered as desired.

In addition to the efforts to detect invisible markings, the one or more cameras 210 cooperate with software to detect other card markings such as smudges, nicks and scuffs and edge demarcations (e.g., notches). The software is configured to analyze a card image (or live feed of the playing card) for unusual markings which are not normally present. In one embodiment, the software is able to evaluate captured playing card data by comparing stored card data against captured card data for differences. For example, an image of an ideal Hoyle®. playing card is stored in memory and used to compare against captured playing card data from one or more Hoyle® decks of cards. In such an embodiment, the shuffler, or other randomization device may include input means for identifying the brand of playing being used or the device may automatically identify the brand of playing cards being used. Alternatively, the software is able to evaluate the captured card data by locating imperfections on one or more playing cards from amongst the aggregate group of playing cards. In this embodiment, images of the cards being used may be compared to one another rather than a stored playing card image. Alternatively, the software is able to evaluate captured playing card data by identifying any non-symmetric or non-pattern marking which is captured. Regardless of the embodiment, the software is evaluating the playing card data captured by the arrangement of illuminators/emitters and sensors/readers to detect anomalies. With a camera positioned to capture a card front (i.e., rank and suit), the software is able to maintain a record of the marking and playing card suit and rank. For example, the software may generate a record of "Ace of Hearts—Notch Along Edge" or "Ace of Hearts—Smudge."

Figure 8:
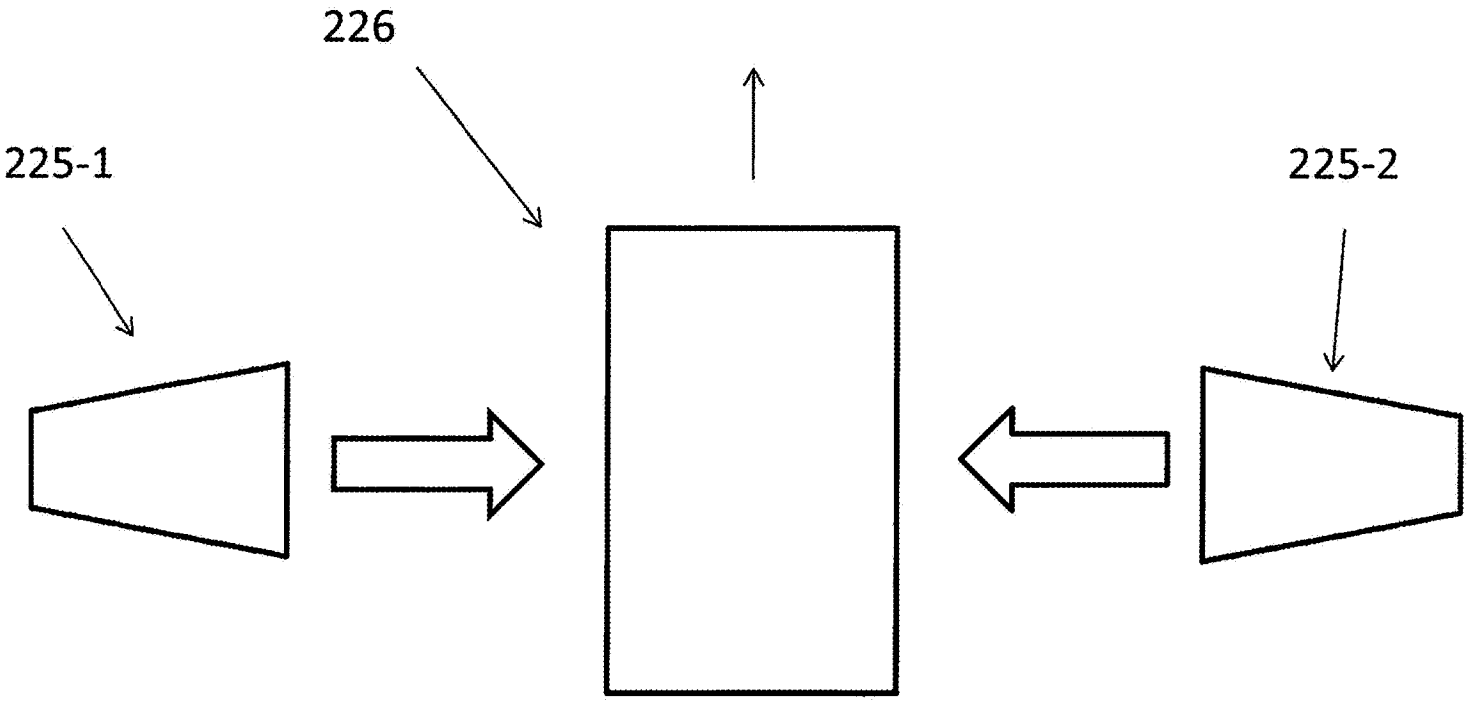
FIG. 8 illustrates an overhead view of a playing card passing between a pair of edge sensors/detectors according to the embodiments of the present invention.

In one embodiment, a pair of edge sensors/detectors 225-1, 225-2 are positioned along opposite long edges of the playing cards as they pass by the pair of edge sensors/detectors 225-1, 225-2. The edge sensors/detectors 225-1, 225-2 are configured to detect bends, waves or snakes in the cards. A single edge sensor along one edge may suffice as well. FIG. 8 shows an overhead view of a playing card 226 passing between a pair of edge sensors/detectors 225-1, 225-2. That is, the edge sensors/detectors 225-1, 225-2 detect whether the playing cards are flat (like they should be) or have some unusual bends or waves. In this instance, the detectors are of a higher resolution but much shorter pulse while using the same illumination sequence as disclosed above. The playing cards trigger different pixels as they undulate up and down while passing by the edge sensors/detectors 225-1, 225-2. The information collected is translated into an amount of warp and/or kink and may be correlated with the rank and suit of the playing card to determine patterns indicating purposeful manipulation.

In one embodiment, the outputs of the camera 210, edge sensors 225-1, 225-2 and/or contact image sensors 310 (and any other card-handling devices configured to read the playing cards) are analyzed by proprietary software to determine if any unusual markings are present. If so, the outputs may be stored in memory 240 and as described below transmitted to casino personnel.

Figure 5:
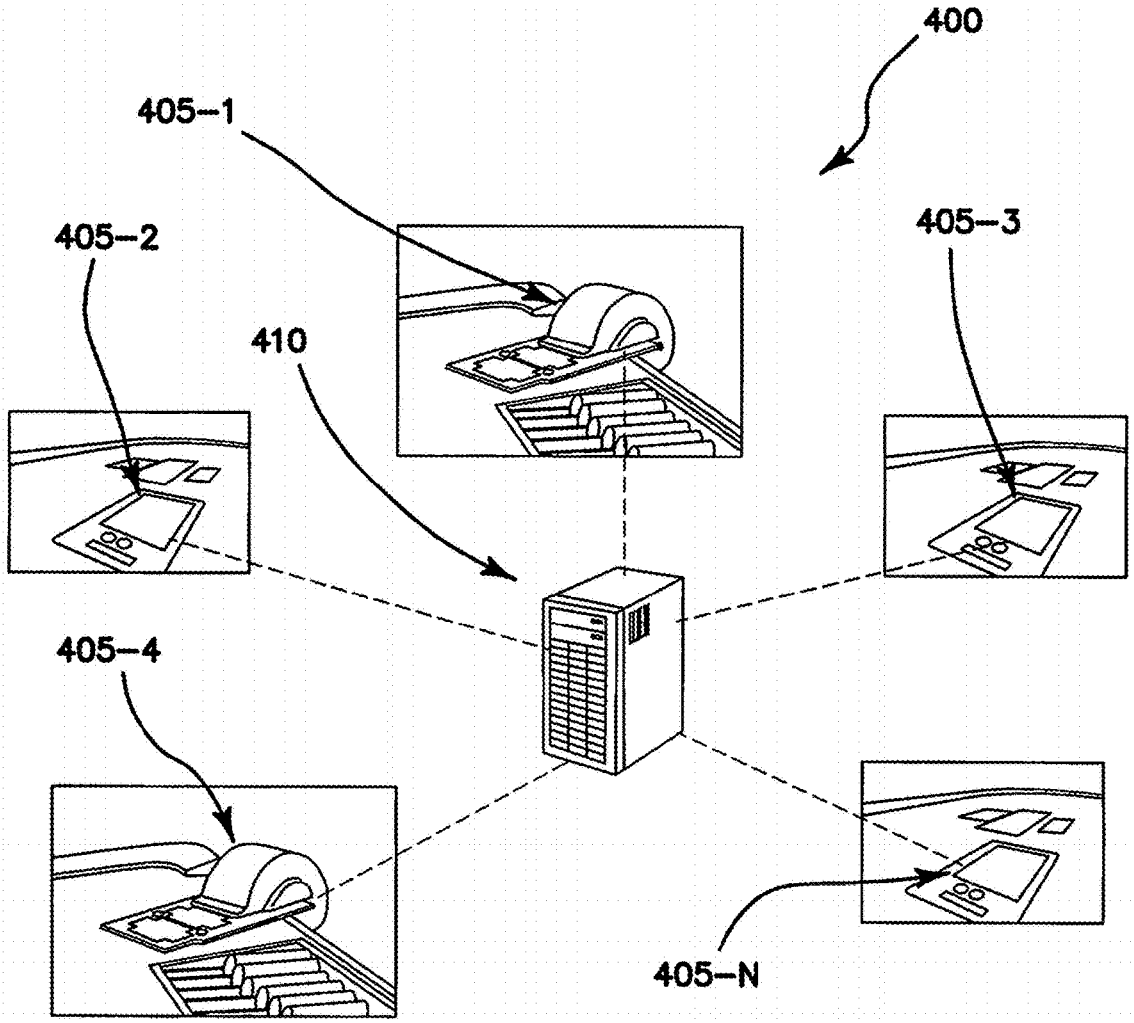
FIG. 5 illustrates a system comprising a series of automatic playing card shufflers and casino management system and/or security system according to the embodiments of the present invention.

FIG. 5 shows a system 400 comprising a series of shufflers 405-1 through 405-N in wireless communication with a casino management system and/or security system running on a remote server 410. Such a system 400 provides casinos with real-time data related to marked cards thereby maintaining the integrity of the casino game within the casino. In one embodiment, the shufflers 405-1 through 405-N communicate with one another.

Figure 6:
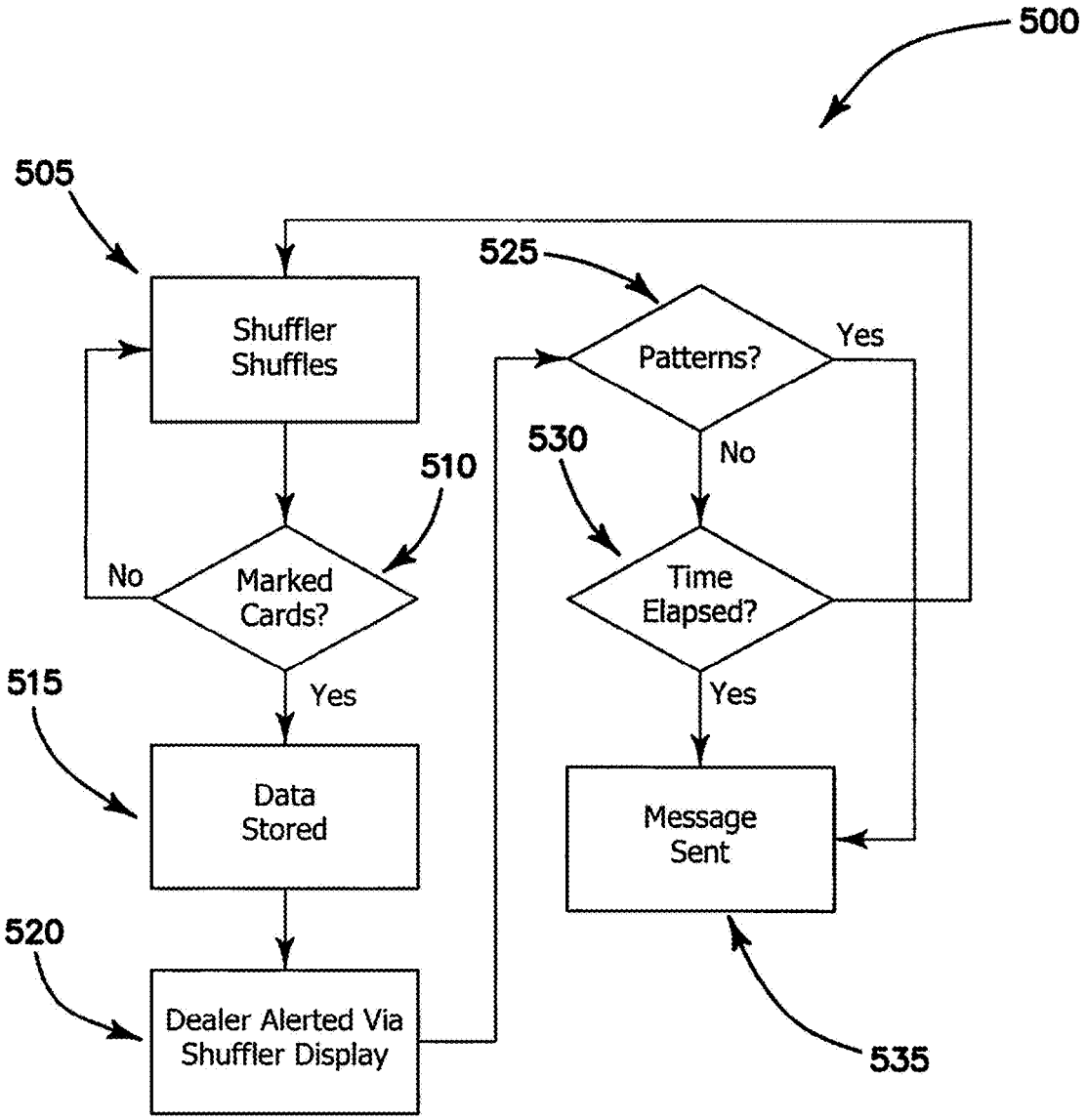
FIG. 6 illustrates a flow chart detailing one methodology for utilizing a system comprising a series of automatic playing card shufflers according to the embodiments of the present invention.

FIG. 6 shows a flow chart 500 detailing one methodology of using an automatic playing card shuffler within the system 400. At 505, the automatic playing card shuffler shuffles cards. At 510, it is determined if any unusual card marks are detected by any of the automatic playing card shuffler. If not, the flow chart 500 loops back to 505. At 515, responsive to detecting a marked card, the automatic playing card shuffler stores related data in memory associated with the automatic playing card shuffler. In one embodiment, the data include the type of mark, and rank and suit of the playing card. At 520, an automatic playing card shuffler display alerts the dealer to a marked card. Ideally, the display is not easily viewable by the players. The display may also be remote from the automatic playing card shuffler (e.g., beneath the table proximate the dealer) and controlled via a wired or wireless communication link. At 525, it is determined if any patterns have been detected by the proprietary software. For example, if the multiple cards with marks are face cards and/or Aces, it is more likely that the marks were placed intentionally. If so, at 535, a wireless message is sent to casino personnel via the casino management system and/or security system. The wireless message may include information such as the table location, marking types and time of the discovery. At 530, it is determined if a pre-established time has elapsed where the pre-established time is triggered by the first discovery of a marked card by the automatic playing card shuffler. If so, at 535, a wireless (or wired) message is transmitted to casino personnel via the casino management system and/or security system. In another embodiment, specific casino personnel may be alerted to the card markings directly by email, SMS and/or instant messages from the automatic playing card shuffler or by email, SMS and/or instant messages triggered by the casino management system and/or security system. In other embodiments, casino personnel are alerted to any and all detections of marked cards immediately upon the detection. An optional receiver 230 incorporated within the automatic playing card shufflers may allow for routine polling of the automatic playing card shufflers. Ultimately, the house or casino determines how to manage the system 400 and detections of marked cards.

Advantageously, the system 400 utilizes collective data from two or more live decks (or sets of decks), two or more shufflers and/or two or more casinos to make game-protection decisions at a single game. The system provides automated protection on all games simultaneously, whether in one casino, or two or more networked casinos, without the need to remove suspect decks from play to conduct tests.

In one embodiment, smart cameras are used within (or mounted to) the shuffler. Smart cameras act as stand-alone vision systems containing a processor and often include image digitalization circuitry, image memory, program and data memory, communication interface (e.g., Ethernet), built-in illumination device (e.g., LED) and/or a real-time operating system. In one embodiment, each shuffler contains at least two computer-vision related processors: a smart camera processor and image processor (separate chip). The two processors combined with a third processor (server) each play a role in conducting the tests and corresponding analytics. Besides smart cameras, line-scan cameras, area-scan cameras, etc.

In one embodiment, the systems 200, 400 are configured to first detect (a) presence, (b) the marks and (c) the corresponding strategy. In other words, the first test detects the anomaly; the second test detects the marks and the third test provides the details, strategy and combination. In one embodiment, the camera's processor performs the first test; the image processor performs the second test; and the server's processor performs the third test.

In one embodiment, as shown in FIGS. 9A-9D, shuffler incorporates cameras and/or sensors and/or emitters positioned below the cards to view the back, side and face of the card simultaneously. This is accomplished by assigning part of a camera or sensor imager to reflect off a mirror to view a card back; assigning part of the camera or sensor image to view a card side; and assigning part of the imager to view a card face. Accordingly, the shuffler images each card in its entirety, including card faces (helping identify rogue dealers). The images are captured as the cards are moving at regular card-shuffling speed. By positioning the cameras, sensors and/or emitters below the cards allows the shuffler to maintain a low profile. Two cameras working with a mirror-based system as described herein can each be positioned at the diagonal corners to view the entire card. Thus, when the present system analyzes the entire deck from the sides, either before (i.e., in the pre-shuffle bin) or after the shuffle (i.e., in the post-shuffle bin) the system is analyzing 52 cards simultaneously. In one embodiment, the cards are imaged while in the air and at normal shuffling speeds.

With sensors built into and concealed in the pre-shuffle bin, shuffler, dealing shoe, post-shuffle bin and discard rack the present invention monitors and analyzes the cards before the shuffle, during the shuffle, after the shuffle, during the deal and after the deal, resulting in multiple layers of confirmation and protection, all occurring during a single round/deal (shuffle to shuffle).

Figure 9A:
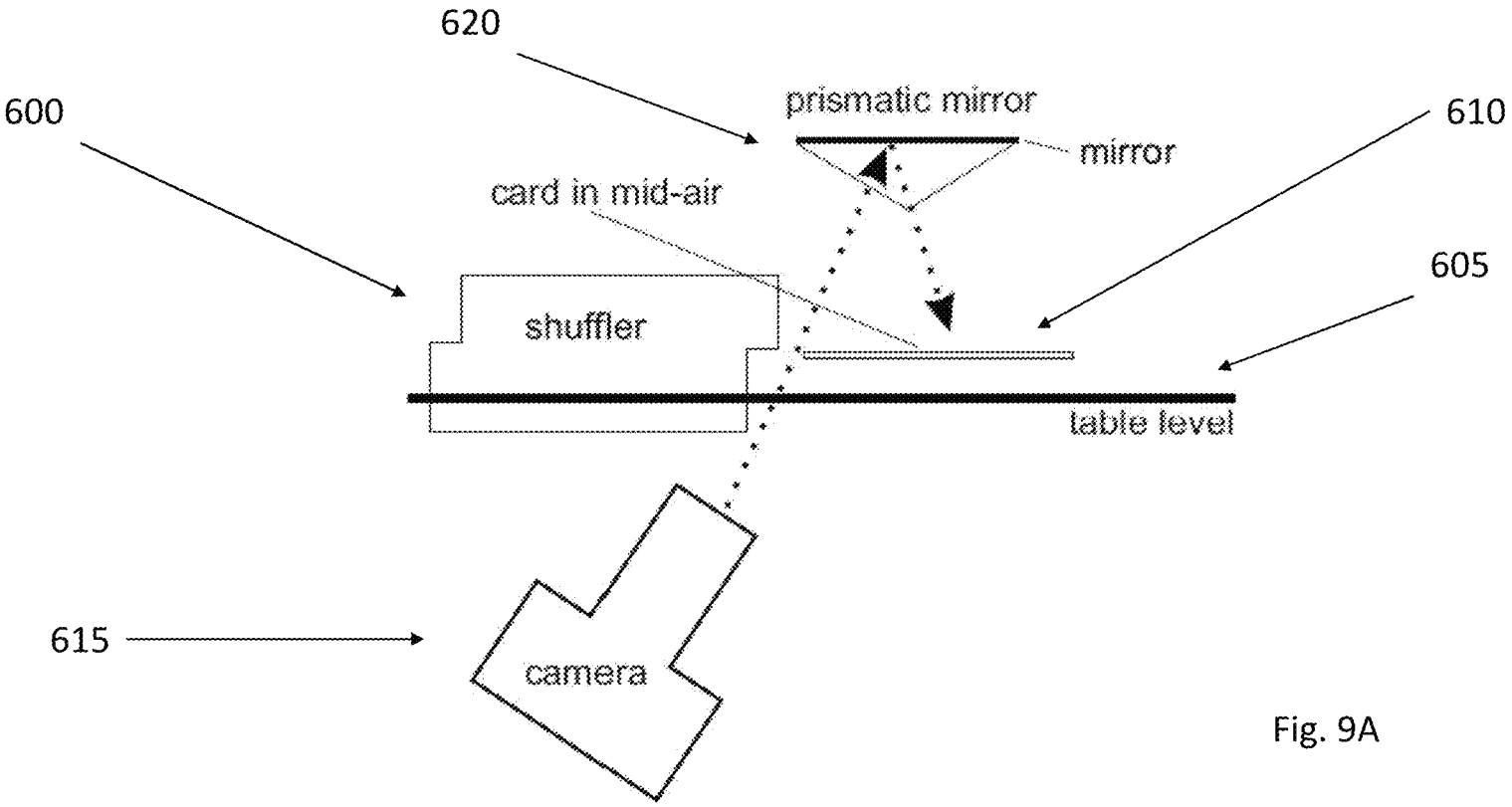
FIGS. 9A-9D illustrate various views of a card-imaging system involving one or more mirrors and cameras according to one embodiment of the present invention.
Figure 9B:
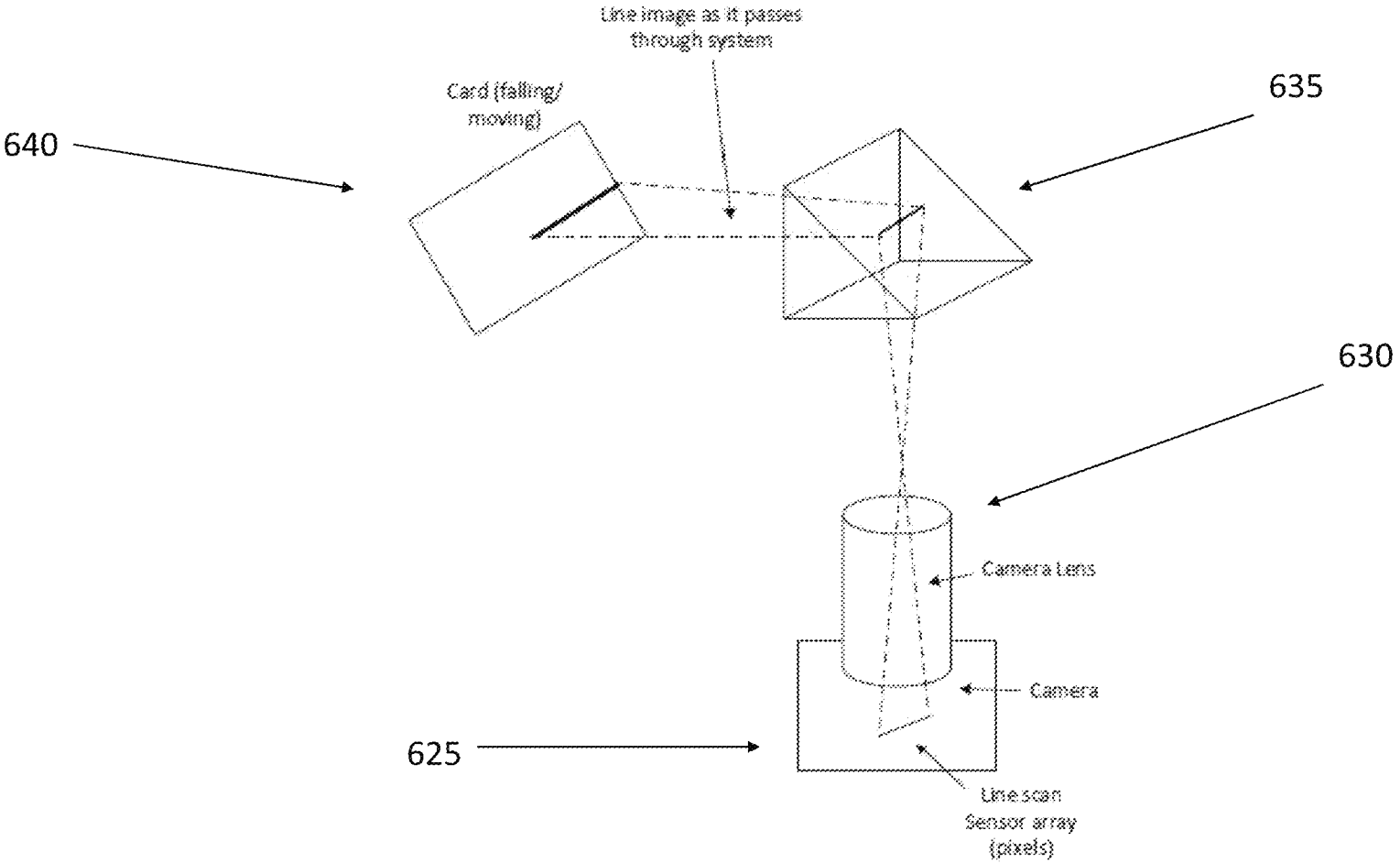
Figure 9C:
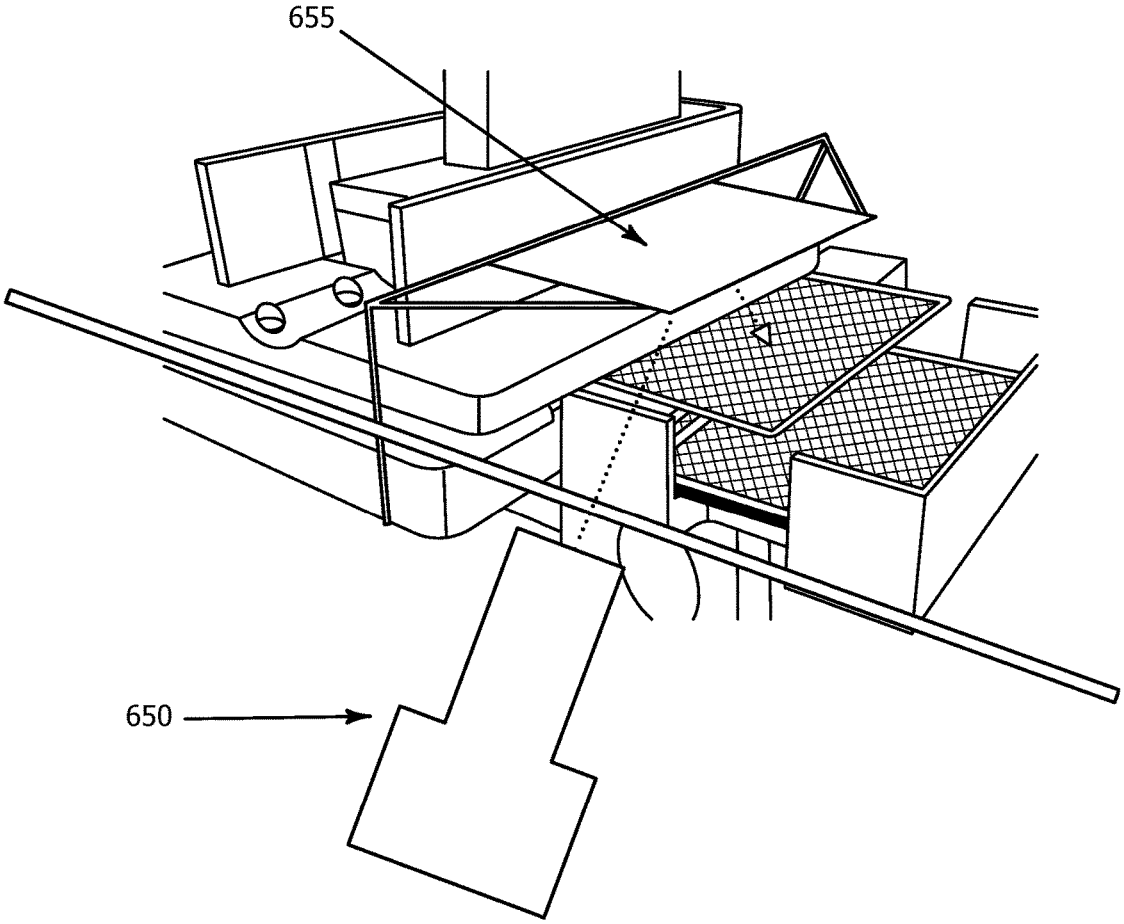
Figure 9D:
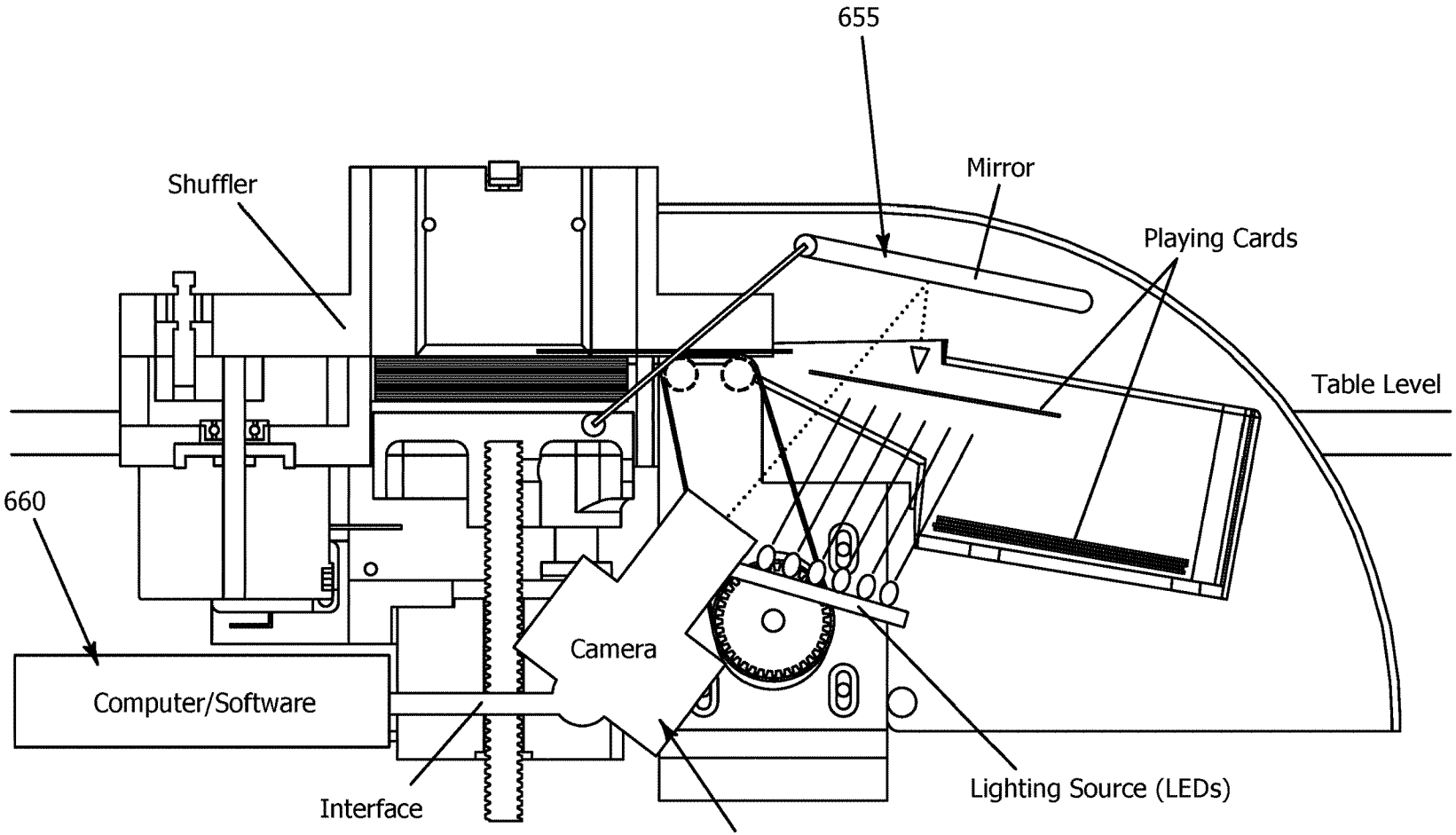

FIGS. 9A-9D depict exemplary shufflers incorporating camera and mirror systems for capturing images of cards as said cards move into, move through and/or exit said shuffler. FIG. 9A shows a shuffler 600 mounted to table 605. As card 610 exits the shuffler 600 into a post-shuffle bin or directly on to the table 605, camera 615 captures an image of the card back via mirror 620. The camera 615 may also capture a direct image of the card face simultaneously. FIG. 9B shows a line scanner sensor array 625, lens 630, prism 635 and passing card 640. The prism 635 permits the line scanner sensor array 625 and lens 630 to be positioned below the card 640. FIGS. 9C and 9D show a camera 650 and mirror 655 positioned within applicant's single deck random-selection shuffler (described in U.S. Pat. No. 9,573,047). FIG. 9D shows a processor/software module 660 for receiving collected data. Again, the camera 650 is below the passing cards and the mirror 655 is above the passing cards to capture at least images of the card backs. Positioning the camera below the passing cards allows the shuffler to maintain a low profile when mounted on a casino table. The low profile prevents the shuffler from interfering with game play on the casino table.

During the detection process, the present system utilizes the degree of measurement to distinguish marks from defects. If a particular measurement is ranked 1-10, where 10 is the strongest indicator of an anomaly, just one or two anomalies, including card manufacturing asymmetries, can suggest foul play whereby only one or two mid-range anomalies may require more data before rendering any conclusions. In other words, some of the tests, when repeated, may have some variance, but the stronger the degree of anomaly, the more weight the measurement/reading is given. Some marking substances can oxidize within hours. By detecting marks immediately (i.e., during the subsequent shuffle), such concerns are eliminated. For example, should a marked deck be introduced from the inside (i.e., the entire deck is marked when it's introduced), it takes only one shuffle for the present system to detect the scam. Not only will the marks be detected, the present system detects the marked-card combination, positively proving the existence of a scam.

Using the degree of anomaly, the present system can detect defects and distinguish them from other anomalies/marks by evaluating (a) the measurement's degree of anomaly, (b) consecutive-round analysis and (c) the corresponding card value. A database of defects is used to compare defects to determine the reliability of the detected defect.

Using historical data can lead to reliable conclusions. For example, after scanning ten million red-backed Bee cards from the United States Playing Card Company during a given time period, if eighteen anomalies are detected on a blackjack table at given dates and times and each anomaly is confirmed to be marked on Tens and Aces, it is apparent a scam is occurring or did occur. Such data evidences intentional markings.

The present system may be programmed to send a first alert or general warning that the analysis on a particular game has hit a certain threshold, which then allows casino personnel to take a closer look at the suspect game. If the action is small, it still might indicate a scam in progress, but before the scammers leave the table. Indeed, round-to-round alerts can be sent to management, giving them real-time updates so they can better monitor and manage the situation. Daily summary reports may be sent to casino personnel to keep them informed as to possible scams. Overall, the system removes human tolerances and relies on cameras/sensors and evaluation software to automatically detect card anomalies.

In one embodiment, the shuffler system does not utilize one or more arbitrary cards—presumably legitimate—for comparison purposes (whether actual cards or database images); instead, the shuffler system uses a statistically significant sample consisting of past and present measurements to define a normal range by which to make comparisons—a sample that may exceed millions of cards. The database maintains a record of card markings such that future markings can be identified by comparison to previously identified and stored markings.

In one embodiment, card images are passed through photo editing software configured to specifically identify card marks. In one example, Adobe Photoshop® is manipulated to reveal or enhance card marks meant to be concealed from the naked eye. Such marks are normally viewed through filters in the form of glasses, sunglasses and/or contact lenses worn by scammers. Manipulating the photo editing software's black, exposure, threshold, hue and/or saturation levels reveals certain marking systems including shading and daubing as well as others.

Figure 10:
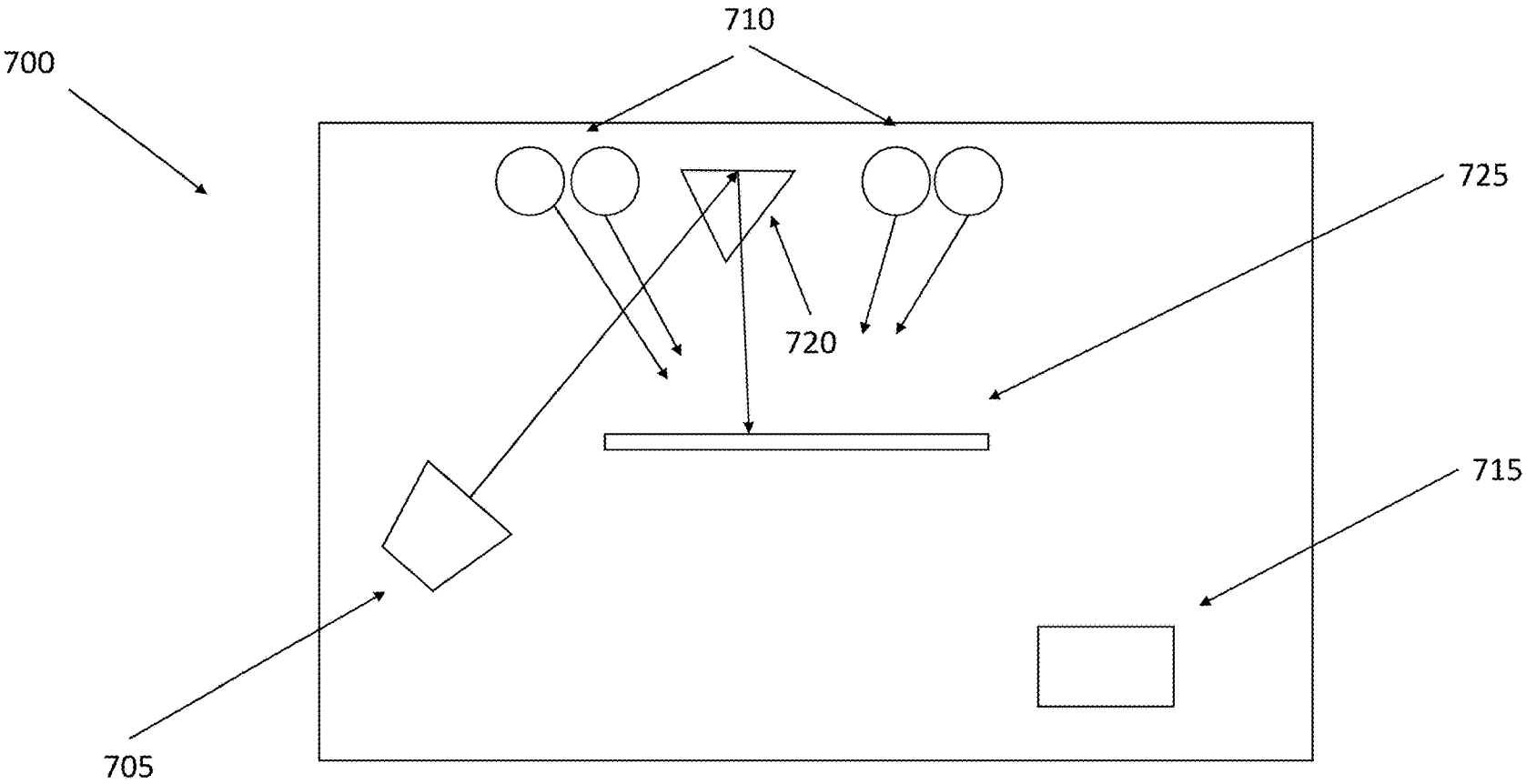
FIG. 10 illustrates a block diagram of a shuffler according to one embodiment of the present invention.

In one embodiment, as shown in the block diagram of FIG. 10, a shuffler 700 according to the embodiments of the present invention may incorporate a line-scan camera (e.g., 2048 line-scan camera) 705 with a 50 mm C-mount lens, a plurality of high-intensity LEDs 710 for lighting the cards passing through the shuffler 700 near the camera 705 and a computer/processor 715 (e.g., 4Sight Gpm by Matrox located in Canada) and prismatic mirror 720. Card 725 is shown passing through an image-capturing area of the shuffler 700 where the camera 705 captures at least an image of the card back as the cards moves therethrough. While one line-scan camera 705 is disclosed, in other embodiments multiple cameras may be used. In other embodiments, the computer/processor 715 may be separate from the shuffler 700. For example, the computer/processor 715 may be attached to the underside of the gaming table to allow the shuffler 700 to remain small in size. It should be understood that the components heretofore described are exemplary and not in any way intended to limit the configuration of the shuffler 700.

Detecting the various card markings and anomalies via a card shuffler utilizes, in one embodiment, unique software routines/applications/modules ("software modules"). The software modules are configured to detect specific markings or anomalies. For example, in one embodiment, a software module is configured to detect cutouts which are is a marking system involving the removal of part of a card design. There are two general methods: chemical and physical. Solvents can penetrate, evaporate, and crystallize the ink so it can be wiped off, although the most common methods entail simply cutting, sanding, and scratching the design—some cheaters, for example, have been known to use hidden strips of sandpaper glued to the fingers. The software module, in this instance, utilizes a standard pattern recognition to conduct a pixel-by-pixel comparison.

In another embodiment, another software module is configured to detect sorts which involves card manufacturing tolerances. Playing cards are manufactured within certain printing and cutting/punching tolerances, so variances may exist in back-design positioning, color, and tone. Variances may also exist as a result of changes in paper, plates, and the environment. The tolerances create differences in decks that allow cards to be sorted from two or more decks and combined to make one marked deck. The software module, in this instance, counts the grayscale pixel values over a predetermined strip along the long sides of each card. The values range from 0-155. The value 0 represents black (no light); the value 255 represents white; everything in-between represents a shade of gray. Assume the classic Bee Card and its all-over diamond back (design runs off the edges; no borders). For one example of a sort deck, assume that the low cards depict ½ diamonds on both sides, but the high cards depict ¼ diamonds on one side and ¾ diamonds on the other (off-set). The software module converts the printed color (e.g., red or blue) to black (value 0) and averages the number of predetermined pixels in a predetermined area. A side with ¾ diamonds will average lower (more zeros) than a side with ¼ diamonds. A side with ½ diamonds will average somewhere in between. Therefore, the software module receives three measurements representing ¾ diamonds, ½ diamonds, and ¼ diamonds. If the software module detects a card's edge with ¾ diamonds or ¼ diamonds, it reads it as 'off-set' and outputs FAIL—a marked card. If the software module detects a card's edge with ½ diamonds, it reads it as evenly cut/punched or printed and outputs PASS—an unmarked card.

Applicant's random-selection shuffler (described in U.S. Pat. No. 9,573,047) is optimal for the marked card detection shuffler technology disclosed herein because the methodology naturally isolates each card during the shuffling process, allowing each card to be imaged in its entirety. Conversely, with random-position shufflers, and most other shufflers, several components and design elements tend to block the view of cameras and sensors. For example, rollers driving cards off the top of the deck can block part of the card. When each card is moved directly onto a platform, or into a bin, shelf, or slot, again, the process can block the camera/sensor.

The inventors have determined that smart cameras can detect up to 90% of marked cards. The other 10% may be captured by measuring size, corner radius, etc. (such tests can be used to detect an entire category of marked cards). Other embodiments may utilize ultrasonic analysis, optical tests that perform a chemical analysis, etc.

In one embodiment, the automatic playing card shuffler is able to track the cards which are dispensed and the order of the same, which along with means for detecting the marked cards, allows a casino to secretly determine which player or players are responsible for marking the cards and discipline them accordingly. By detecting scams secretly, casino personnel can determine which player(s) are part of the scam.

The system may also identify normal wear and tear associated with shuffled playing cards so that casinos may determine when to swap out decks. This can result in savings to the casinos.

Besides automatic playing card shufflers, deck verification devices and card sorting devices, applicant has conceived of incorporating certain components (e.g., emitters and spectral filters) into a pair of eyeglasses whereby a user is able to detect certain card markings when wearing the eyeglasses. Applicants incorporate herein by reference Application No. 61/830,565 filed Jun. 3, 2013 and entitled Mobile Device for Detecting Marked Cards and Method of Using the Same.

Although the invention has been described in detail with reference to several embodiments, additional variations and modifications exist within the scope and spirit of the invention as described and defined in the following claims.

We claim:

1. A card shuffling system comprising:

multiple automatic card shuffler devices each including:

one or more mechanisms for re-arranging cards from one or more decks of cards into a shuffled one or more decks of cards;

one or more cameras incorporated therein or mounted thereon;

one or more illuminators for illuminating an area near a focus of said one or more cameras; and a transmitter configured to send data from said one or more cameras to a remote location, said data including at least images of backs of cards from said one or more decks of cards; and one or more local and/or remote processors configured to evaluate said data to detect anomalies and card markings associated with said cards, said one or more local or remote processors further configured to cause a comparison of captured card back images for each card back against captured card back images for each other card to determine undesirable markings and anomalies associated with any of said playing cards within said one or more decks of playing cards.

2. The card shuffling system of claim 1 further comprising a server configured to at least receive said data sent by said transmitter of each of said multiple card shuffler devices.

3. The card shuffling system of claim 1 wherein each of said multiple card shuffler devices further includes a processor.

4. The card shuffling system of claim 1 wherein said multiple card shuffler devices communicate with one another.

5. The card shuffling system of claim 1 further comprising one or more mirrors positioned to allow said one or more cameras to capture images of a card back, card sides and a card face.

6. The card shuffling system of claim 1 further comprising electronic storage configured to maintain data associated with card data captured by said one or more cameras.

7. The card shuffling system of claim 1 further comprising photo editing software for enhancing card images to reveal hidden card marks.

8. The card shuffling system of claim 1 wherein said multiple card shuffler devices are located in two or more casino properties.

9. A card shuffling system comprising:

multiple automatic card shuffler devices each including:

one or more mechanisms for re-arranging cards from one or more decks of cards;

at least one camera having a processor;

an image processor;

one or more illuminators; and a transmitter configured to send data from said camera processor and said image processor, said data including at least images of backs of cards; and a remote server configured to at least receive said data from said multiple card shufflers and evaluate said data along with historical data to determine card markings and anomalies, said remote server further configured to cause a comparison of captured card back images for each card back against captured card back images for each other card to determine undesirable markings and anomalies associated with any of said playing cards within said one or more decks of playing cards.

10. The card shuffling system of claim 9 further comprising one or more mirrors positioned to allow said at least one camera to capture images of a card back, card sides and a card face.

11. The card shuffling system of claim 9 further comprising electronic storage configured to maintain data associated with card data captured by said at least one camera.

12. The card shuffling system of claim 9 further comprising photo editing software for enhancing card images to reveal hidden card marks.

13. The card shuffling system of claim 9 wherein said multiple card shuffler devices are located in two or more casino properties.

14. A method of detecting card marks comprising:

utilizing multiple random-selection automatic card shufflers at one or more locations to shuffle cards, said multiple random-selection card shufflers having at least a camera to capture card images;

capturing images of at least one of card backs, sides and faces as cards are re-arranged by said one or more random-selection card shufflers;

collecting card data comprising at least images of at least one of said card backs, sides and faces; and evaluating said card data along with historical card data to determine card markings and anomalies wherein said evaluating comprises a comparison of captured card back images for each card back against captured card back images for each other card to determine undesirable markings and anomalies associated with any of said playing cards within said one or more decks of playing cards.

15. The method of claim 14 further comprising utilizing a camera processor in each of said one or more random-selection automatic card shufflers to first detect anomalies and an image processor to second detect marks.

16. The method of claim 14 further comprising utilizing a remote server to store collected and historical card data.

17. The method of claim 14 further comprising utilizing photo editing software for enhancing card images to reveal hidden card marks.

18. The method of claim 14 wherein said step of evaluating said card data along with historical card data to determine card anomalies suggestive of improper card markings comprises utilizing a degree of measurement procedure to distinguish marks from defects.

19. The method of claim 14 wherein said step of evaluating said card data along with historical card data to determine card anomalies suggestive of improper card markings comprises utilizing (a) said measurement's degree of anomaly, (b) consecutive-round analysis and (c) corresponding card value to distinguish marks from defects.

20. A card shuffling system comprising:

multiple automatic card shuffler devices each comprising (i) one or more mechanisms for re-arranging cards from one or more decks of cards;

(ii) one or more cameras incorporated therein or mounted thereon; and (iii) one or more illuminators for illuminating an area near a focus of said one or more cameras; and one or more software modules configured to evaluate one or more card markings and/or anomalies wherein said evaluation comprises a comparison of captured card back images for each card back against captured card back images for each other card to determine undesirable markings and anomalies associated with any of said playing cards within said one or more decks of playing cards.

21. The card shuffling system of claim 20 wherein each of said multiple automatic card shuffler devices includes a transmitter configured to send data from said one or more cameras to a remote location, said data including at least images of backs of cards from said one or more decks of cards.

22. The card shuffling system of claim 21 further comprising a server configured to receive said data sent by said transmitter of each of said multiple automatic card shuffler devices.

23. The card shuffling system of claim 20 wherein said server runs said one or more software modules.

24. The card shuffling system of claim 20 wherein each of said multiple automatic card shuffler devices further includes an associated processor.

25. The card shuffling system of claim 20 further comprising one or more mirrors positioned to allow said one or more cameras to capture images of a card back, card sides and a card face.

26. A method of detecting card marks comprising:

utilizing multiple random-selection automatic card shufflers at one or more locations to shuffle cards, each of said multiple random-selection card shufflers having at least a camera to capture card images;

capturing images of at least one of card backs, sides and faces as cards are re-arranged by said one or more random-selection card shufflers;

collecting card data comprising at least images of at least one of said card backs, sides and faces; and utilizing one or more software modules to determine card markings and/or anomalies wherein said evaluation comprises a comparison of captured card back images for each card back against captured card back images for each other card to determine undesirable markings and anomalies associated with any of said playing cards within said one or more decks of playing cards.

27. A card shuffling system comprising:

multiple automatic card shuffler devices configured to randomly shuffle one or more decks of cards, said multiple automatic card shuffler devices each including:

one or more cameras incorporated therein or mounted thereon;

one or more illuminators for illuminating an area near a focus of said one or more cameras; and a transmitter configured to send data from said one or more cameras to a remote location, said data including at least images of backs of cards from said one or more decks of cards; and one or more local and/or remote processors configured to evaluate said data to detect anomalies and card markings associated with said cards, said one or local or remote processors further configured to cause a comparison of captured card back images for each card back against captured card back images for each other card to determine undesirable markings and anomalies associated with any of said playing cards within said one or more decks of playing cards.

* * * * *